US008141628B2

(12) United States Patent
Hart

(10) Patent No.: US 8,141,628 B2
(45) Date of Patent: Mar. 27, 2012

(54) DOWNHOLE DEBURRING TOOL

(75) Inventor: Paul Douglas Hart, Lowestoft (GB)

(73) Assignee: Precision Energy Services, Inc., Fort Worth, TX (US)

( * ) Notice: Subject to any disclaimer, the term of this patent is extended or adjusted under 35 U.S.C. 154(b) by 281 days.

(21) Appl. No.: 11/967,384

(22) Filed: Dec. 31, 2007

(65) Prior Publication Data

US 2009/0169319 A1 Jul. 2, 2009

(51) Int. Cl.
*E21B 37/00* (2006.01)

(52) U.S. Cl. ..... 166/173; 166/175

(58) Field of Classification Search ..... 166/241.4, 166/241.6, 241.7, 172, 173, 174, 175; 175/172, 175/173, 174, 175; 408/154
See application file for complete search history.

(56) References Cited

U.S. PATENT DOCUMENTS 3,251,418 A * 5/1966 Condra ..... 166/173
4,165,201 A 8/1979 Heule
4,842,082 A * 6/1989 Springer ..... 175/279
4,844,670 A 7/1989 Heule
5,351,758 A * 10/1994 Henderson et al. ..... 166/277
5,803,679 A 9/1998 Heule
6,152,221 A * 11/2000 Carmichael et al. ..... 166/174
2006/0108117 A1* 5/2006 Telfer ..... 166/311

* cited by examiner

*Primary Examiner* — Daniel P Stephenson
*Assistant Examiner* — Kipp Wallace
(74) *Attorney, Agent, or Firm* — Wong, Cabello, Lutsch, Rutherford & Brucculeri, L.L.P.

(57) ABSTRACT

A downhole deburring tool is equipped with retractable cutters which permit it to fit through restrictions in a wellbore—e.g., a subsurface safety valve—and subsequently expand to deburr or scrape a section of tubing having an internal diameter greater than that of the restriction. In one preferred embodiment, tapered surfaces on the tool act to effect retraction of the cutters during withdrawal of the tool from a wellbore. Deburring operations with the tool may increase the effectiveness of bridge plugs and/or ball sealer systems to permit chemical treatment of selected zones. Scraping operations with the tool to remove scale, corrosion and other material from the inner surface of a well tubular can increase the effective diameter of the tubing thereby allowing greater production.

8 Claims, 5 Drawing Sheets

DOWNHOLE DEBURRING TOOL

CROSS-REFERENCE TO RELATED APPLICATIONS

None

STATEMENT REGARDING FEDERALLY SPONSORED RESEARCH OR DEVELOPMENT

Not Applicable

BACKGROUND OF THE INVENTION

1. Field of the Invention

This invention relates to well servicing tools. More particularly, it relates to wireline tools used to finish or repair the interior surface of well casing tubulars.

2. Description of the Related Art including information disclosed under 37 CFR 1.97 and 1.98

A burr is a deformation of metal wherein a raised edge forms on a metal part which has been machined or otherwise formed. It may be present in the form of a fine wire on the edge of a freshly sharpened tool or as a raised portion on a surface, after being struck a blow from an equally hard, or heavy object.

More specifically, burrs are generally unwanted material remaining after a machining operation such as grinding, drilling, milling, or turning. Burr formation in machining accounts for a significant portion of machining costs for manufacturers in America and around the world. Drilling burrs, for example, are common when drilling almost any material.

Deburring tools may be used where the burr from a previous metal-working operation needs to be removed for cosmetic, safety or performance reasons.

FIG. 6 depicts a wellbore 10 of the prior art in formation F. Wellbore 10 comprises casing 12 which has been perforated in production zone P with perforations 40. Fractures 42 in formation F have been created to enhance the flow of hydrocarbon products from formation F into wellbore 10. Also shown in FIG. 6 are polymer sealing balls 44 which may be used to selectively plug perforations 40 in certain regions of the well. In this way, different production zones may be selectively treated e.g. with an acid treatment or a certain proppant. Fluid pressure within wellbore 10 acts to seat balls 44 in perforations 40 thereby preventing the flow of treatment fluid(s) pumped into wellbore 10 from entering production zone P. Certain perforations 40 in casing 12 are shown in the sealed condition with seated balls 44'. After treating a different production zone (or region of the well), fluid pressure within wellbore 10 may be reduced thereby permitting fluids to flow from formation F into the wellbore, dislodging seated balls 44'

It will be appreciated by those skilled in the art that the sealing effectiveness of polymer balls 44 depends, at least in part, on the smoothness of perforations 40. Inasmuch as perforations 40 are typically formed using shaped-charge explosive devices ("perforating guns"), the holes are often rough. Deburring the holes provides a smoother wellbore (which is less disruptive to fluid flow) and also provides a better seat for polymer sealing balls 44.

BRIEF SUMMARY OF THE INVENTION

A preferred embodiment of the deburring tool of present invention comprises spring-loaded cutting dogs which expand in a radial direction for deburring or scraping operations and which may retract upon encountering a restriction in the internal diameter of the well casing. The deburring tool may be used in pairs to achieve substantially 360° coverage of the inner surface of a well's casing (or other tubular element).

Without deburring, burrs and other particles present on the side walls of the tubing reduce the effectiveness of the elastomeric elements of bridge plugs to seal against and grip the inner wall of the tubing. In practice, valves under the upward force of well pressure and the downward force of acid pumping have became dislodged and blown down or up the well, necessitating major fishing operations costing millions of dollars. In similar fashion, deburring increases the effectiveness of ball sealer systems to be set in the desired area to provide production zone shutoff. Use of a tool according to the invention prior to setting a bridge plug has been shown to provide a significant improvement in bridge plug setting efficiency. The tool may also be used for corrosion removal of perforated tubing.

In one particular preferred embodiment, the deburring tool comprises a carriage moveable in an axial direction between a first position and a second position. Retractable cutters connected to the carriage move from a first position wherein the tool has a first, smaller outside diameter to a second position in which the tool has a second, larger outside diameter. A shear pin restrains the carriage in a first position until a pre-selected force urging the carriage towards the second position is exceeded.

In certain embodiments, selected surfaces of the cutter are sloped or tapered to provide a cam-type action when the tool encounters a restricted diameter during withdrawal from a wellbore. The cam-type action urges the cutters into the retracted position, thereby reducing the outside diameter of the tool and permitting to pass through regions of reduced inside diameter, such as subsurface safety valves and the like.

BRIEF DESCRIPTION OF THE SEVERAL VIEWS OF THE DRAWING(S)

DETAILED DESCRIPTION OF THE INVENTION

In order to allow hydrocarbons to flow from a formation into a cased wellbore, the casing may be perforated to create holes in the casing or liner to achieve efficient communication between the reservoir and the wellbore. The characteristics and placement of the communication paths (perforations) can have significant influence on the productivity of the well. A perforating gun assembly with the appropriate configuration of shaped explosive charges and the means to verify or correlate the correct perforating depth can be deployed on wireline, tubing or coiled tubing.

Hydraulic fracturing is a stimulation treatment routinely performed on oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of formation and bypasses any damage that may exist in the near-wellbore area.

Matrix acidizing is the treatment of a reservoir formation with a stimulation fluid containing a reactive acid. In sandstone formations, the acid reacts with the soluble substances in the formation matrix to enlarge the pore spaces. In carbonate formations, the acid dissolves the entire formation matrix. In each case, the matrix acidizing treatment improves the formation permeability to enable enhanced production of reservoir fluids. Matrix acidizing operations are ideally performed at high rate, but at treatment pressures below the fracture pressure of the formation. This enables the acid to penetrate the formation and extend the depth of treatment while avoiding damage to the reservoir formation.

Figure 6:
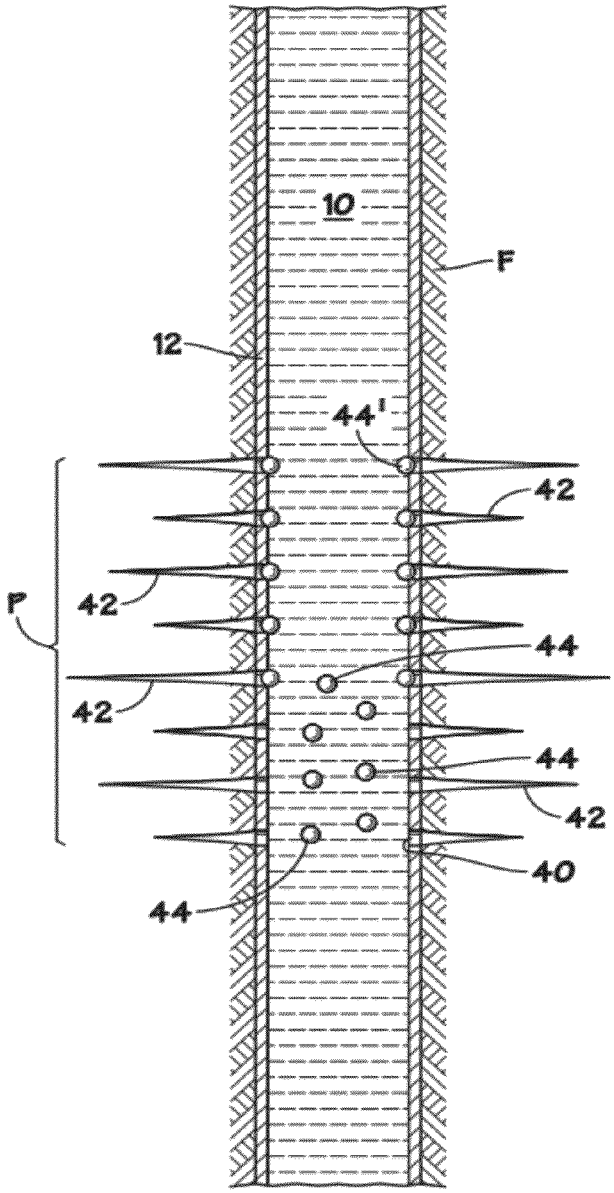
FIG. 6 (PRIOR ART)
FIG. 6 is a cross-sectional view of a perforated section of well casing temporarily plugged with polymer spheres, according to a prior art technique for selective zone well treatment.

As described above, bridge plugs or polymer balls (as depicted in FIG. 6) may be used to selectively block perforations in a well casing to permit different treatments to be applied to different portions or production zones of a well without exposing other portions to the treatment agent.

Subsurface Safety Valves (SSVs) are often deployed in hydrocarbon producing wells to shut off production of well fluids in emergency situations. Such SSVs are typically fitted into production tubing in the wellbore, and operate to block the flow of formation fluids upwardly through the production tubing should a failure or hazardous condition occur at the well surface.

SSVs are designed either to be slickline retrievable, or tubing retrievable. If a safety valve is configured to be slickline/wireline retrievable (WRSSV), it can be easily removed and repaired. If the SSV forms a portion of the well tubing, it is commonly known as "tubing retrievable" (TRSSV). In this instance, the production tubing string must be removed from the well to perform any safety valve repairs. SSV's may have a smaller internal diameter than casing below the SSV. The SSV may thereby effectively restrict the diameter of conventional tools which may be deployed below the SSV. The present invention solves the problem of passing a deburring tool through a more narrow portion of a well bore for operation in section of the wellbore having a greater internal diameter.

The invention may best be understood by reference to the particular preferred embodiment illustrated in the drawing figures.

Figure 1:
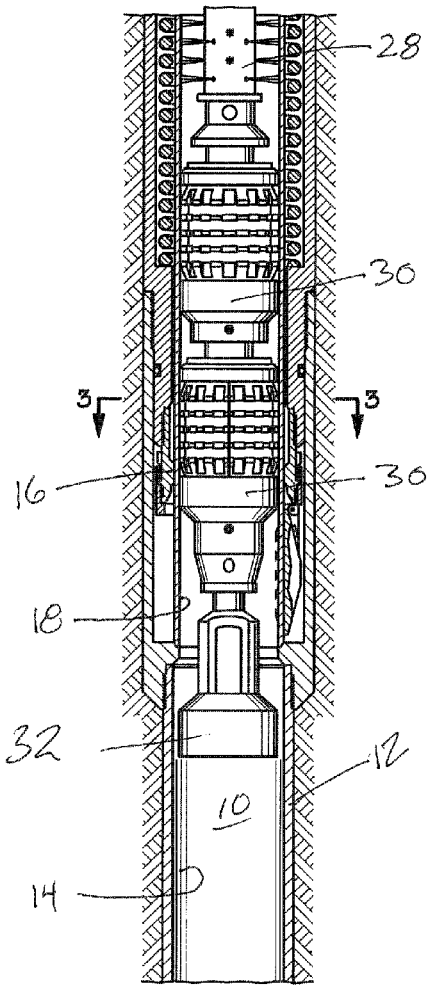
FIG. 1 depicts a tool string comprising a pair of deburring tools according to the invention being run in hole in a cross-sectioned, subterranean well bore.

Referring to FIG. 1, a pair of downhole deburring tools 30 according to one embodiment of the invention is shown as part of a tool string in a wellbore 10 comprised of tubular casing 12 having internal diameter (I.D.) 14. The well tubing also comprises tubing-retrievable subsurface safety valve (TRSSV) 16 having internal diameter 18 (which may be less than I.D. 14 of casing 12). It will be appreciated that TRSSV 16 forms a portion of the well tubing and its internal diameter 18 may be the limiting factor which dictates the maximum outside diameter (O.D.) of conventional downhole tools which may be deployed in the well.

Figure 2:
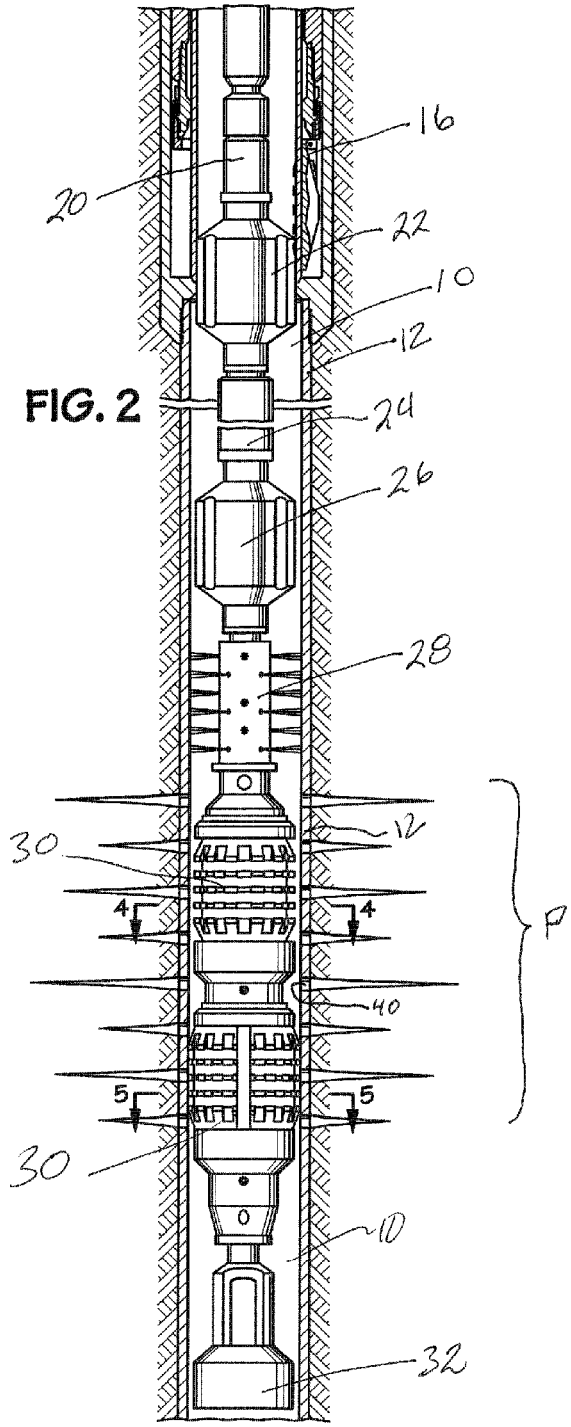
FIG. 2 depicts a tool string comprising a pair of deburring tools according to the invention in operating condition in a cross-sectioned, subterranean well bore.
Figure 3:
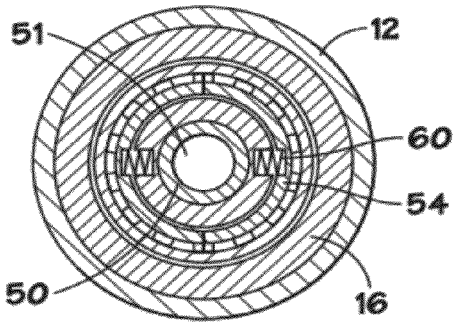
FIG. 3 is a cross-sectional view taken along line 3-3 in FIG. 1.
Figure 4:
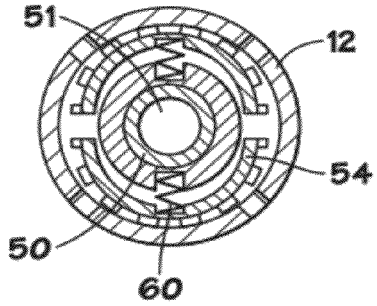
FIG. 4 is a cross-sectional view taken along line 4-4 in FIG. 2.
Figure 5:
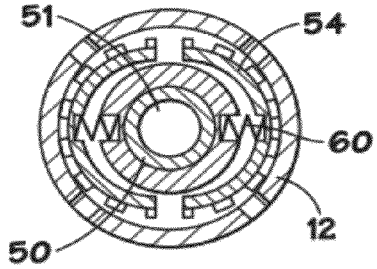
FIG. 5 is a cross-sectional view taken along line 5-5 in FIG. 2.

In addition to deburring tool 30, the illustrated tool string comprises knuckle joint/crossover 20 (as shown in FIG. 2), fluted centralizer 22, stem 24, 5.85-inch fluted centralizer 26, brush assembly 28 and gauge cutter 32, all of which are conventional in the art. The gauge cutter is designed to cut away paraffin, scale, or other debris from the ID of the tubing. Cutting operations can be performed with the well flowing or while circulating, so that the debris flows from the well as it is cut. It is good practice to make a gauge cutter run prior to running any downhole tools, particularly prior to setting and retrieving packers and plugs. The gauge cutter size is selected depending on the minimum restriction inside the wellbore completion. It is made up at the bottom of the tool string and run into the well. On its path down the tubing, it cuts paraffin, wax, and other soft debris from the tubing. However, the gauge cutter diameter (gauge) must be selected to accommodate the smallest I.D. of the well tubing. Hence, burrs, scale and other buildup on the interior surface of larger I.D. portions of the well tubing will not be completely removed by a gauge cutter.

Figure 7:
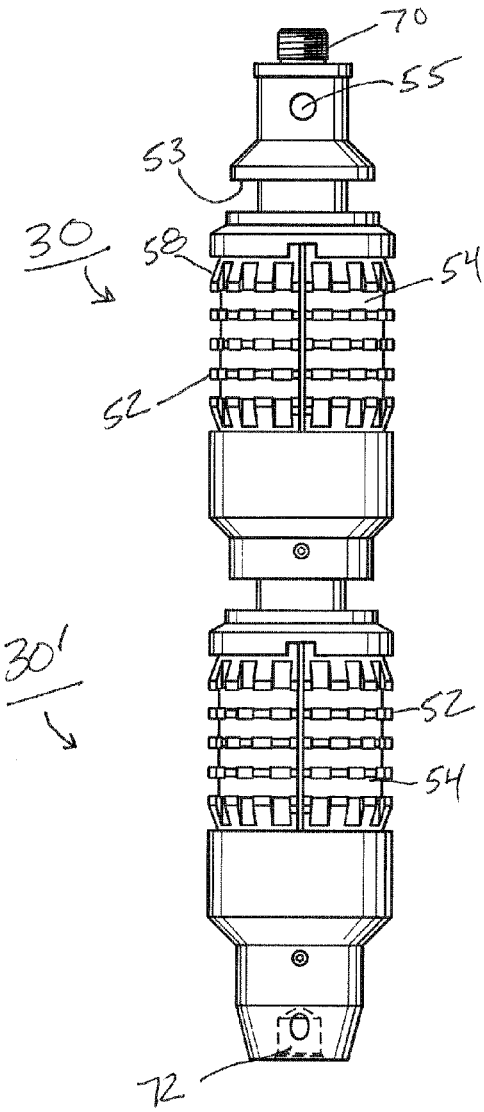
FIG. 7 is an elevation of a pair of deburring tools according to the invention connected together in-phase (for purposes of illustration).

Tool strings comprising a deburring tool according to the invention may include additional or fewer components as the downhole conditions and particular well configuration may dictate. As illustrated in FIGS. 1 and 2, deburring tool 30 may typically be paired in a tool string with an additional deburring tool positioned such that its retractable cutters are oriented 906° about the central axis relative to the cutters on the other deburring tool so that deburring may be effected substantially throughout 360 degrees. FIG. 7 shows deburring tool 30 joined to deburring tool 30'. For purposes of illustration only, the tools are shown aligned in the same direction. When in operating configuration, the two tools 30 and 30' are preferably aligned 90° "out of phase" with each other to achieve substantially 360° coverage of the inner wall—i.e., the retractable cutters of tool 30 are oriented 90° about the central axis relative to the cutters on deburring tool 30'

FIG. 2 shows the tool string illustrated in FIG. 1 deployed deeper in wellbore 10—i.e., past TRSSV 16. Deburring tools 3 are now in production zone P, in position to deburr perforations 40 in casing 12.

Figure 8:
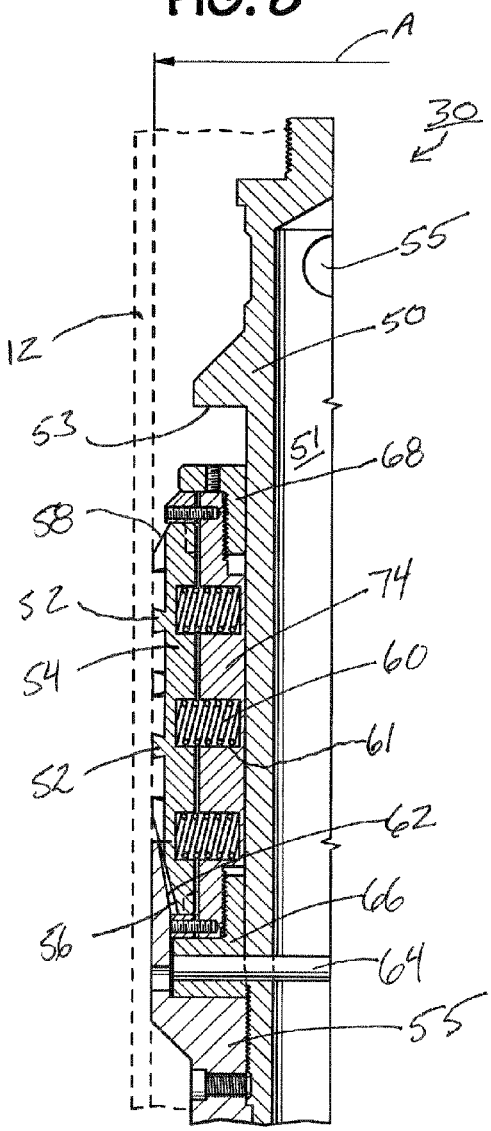
FIG. 8 is a cross-sectional view of a deburring tool according to the invention in run-in mode with the cutting teeth retracted.

FIG. 8 shows deburring tool 30 in running mode—i.e., configured so as to be run into a well on a tool string with cutters 52 retracted so as to reduce the O.D. of the tool and permit it to pass through certain restrictions in the well bore. In the illustrated embodiment, the deburring tool 30 has an overall O.D. with its cutters retracted that permits it to pass through a TRSSV having an internal diameter A of 5.963 inches. Tubing 12 is shown in phantom.

Deburring tool 30 comprises mandrel 50 having externally threaded connecter 70 at a first end and internally threaded connector 72 at a second end. Mandrel 50 may comprise internal cavity 51 in fluid communication with fluid passages 55 which permit the passage of well fluids through the tool. Circulating fluids may be used to remove metal cuttings from the wellbore, as is conventional in the art.

Deburring cutters or teeth 52 are attached to or formed in the outer circumference of floating carrier 54. Carrier 54 is mounted on carriage 74 which may move axially on mandrel 50. Carriage 74 is slidably secured to mandrel 50 with lower retainer 66 at a first end and upper retainer 68 at a second end. Axial movement of carriage 74 in the upward direction is limited by shoulder 53 on mandrel 50.

Cavities 61 in carriage 74 contain resilient elements 60 which bias carrier 54 in an outward, radial direction. In the illustrated embodiment, resilient elements 60 comprise coiled springs.

In the running mode illustrated in FIG. 8, outward radial movement of carrier 54 is prevented by the contact of tapered surface 62 with surface 56 on carrier 54. Axial movement of carriage 74 on mandrel 50 is prevented by shear pin 64. Thus, when shear pin 64 is intact, cutters 52 are held in a retracted position.

Figure 9:
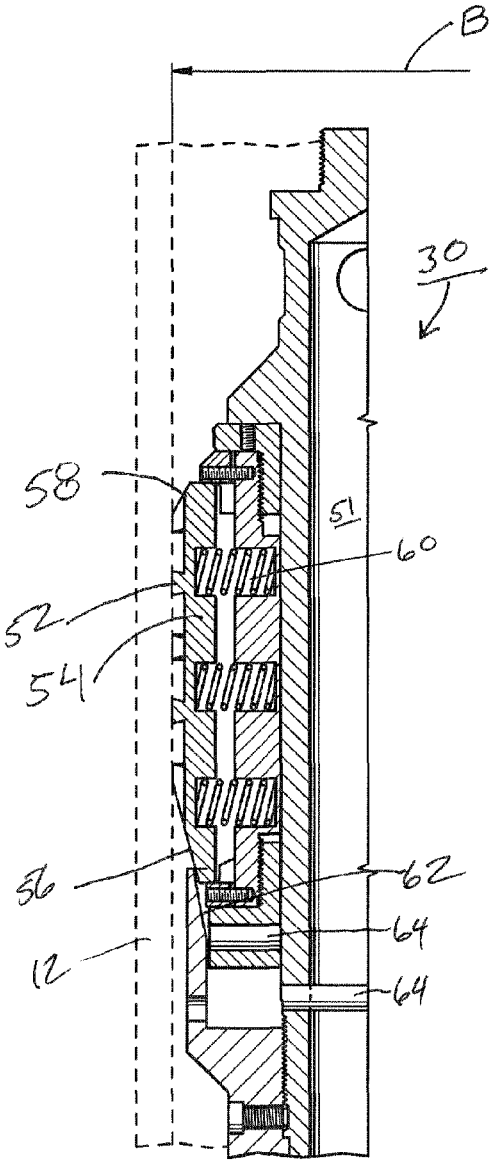
FIG. 9 is a cross-sectional view of a deburring tool according to the invention in operating mode with the cutting teeth extended.

FIG. 9 depicts deburring tool 30 with its cutters deployed in a section of tubing 12 (shown in phantom) having internal diameter B (which may be greater than internal diameter A shown in FIG. 8). Pin 64 has sheared and carriage 74 has moved in an upward axial direction on mandrel 50. This axial movement changes the contact position of tapered surface 62 and surface 56 on carrier 54 allowing floating carrier 54 to move radially outward under the influence of springs 60 until cutters 52 contact the interior surface of the well tubing. In the illustrated embodiment, this well tubing has an internal diameter of from about 6.3 to about 6.4 inches, which is larger than the internal diameter of a TRSSV located higher in the well. Radial movement of floating carrier 54 may also be limited by the contact of the upper retainer 68 with shoulder 53 and the resulting contact point of surfaces 62 and 56. In this way, variations in the internal diameter of the well tubing may be accommodated, to a degree.

Deployment of cutters 52 on carrier 54 may be effected by lowering the deburring tool 30 until restrictions in the well bore (such as burrs or scale) contact cutters 52 thereby creating a drag force on the tool. This drag force acts to urge carriage 74 towards shoulder 53 as the tool is lowered. When the drag force is sufficient to shear pin 64, carriage 74 moves axially on mandrel 50 and floating carrier 54 extends in a radial direction. The drag force necessary to effect deployment of cutters 52 may be varied by selecting the shear strength of pin 64. As will be appreciated by those skilled in the art, the shear strength may be affected by the material of pin 64 and/or its size (diameter). In one particular preferred embodiment, shear pin 64 is brass and the remainder of the deburring tool is steel.

Figure 10:
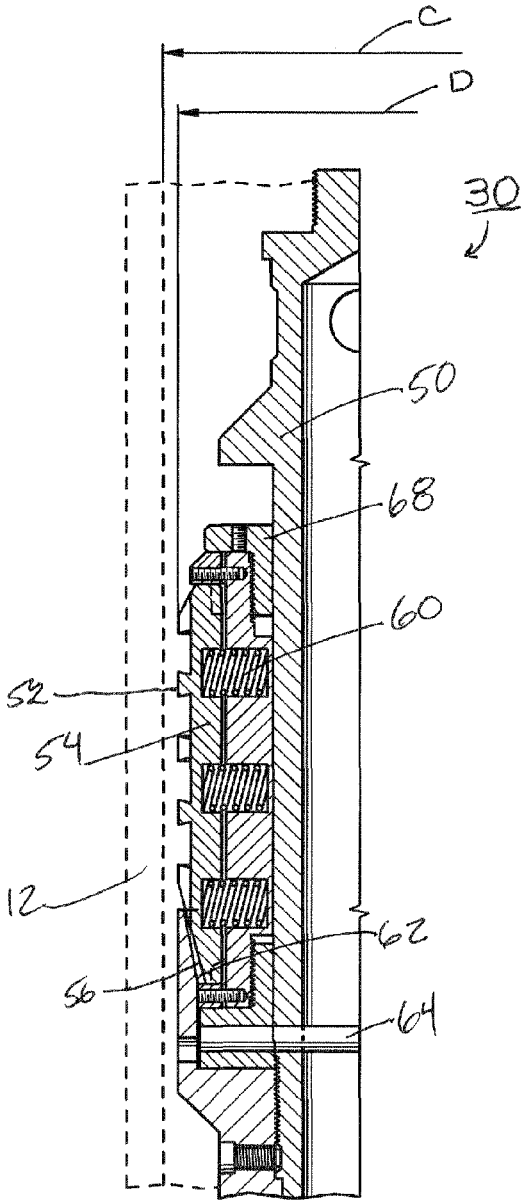
FIG. 10 is a cross-sectional view of a deburring tool according to the invention shown as it is being withdrawn from a well bore with the cutting teeth retracted.

FIG. 10 depicts deburring tool as it is being withdrawn from the wellbore. Although located in a section of tubing 12 (shown in phantom) having internal diameter C, the tool has an outer diameter D which is less than C. As the tool is pulled up, the drag force acting on cutters 52 acts to urge carriage 74 in a downward axial direction (relative to mandrel 50) and away from shoulder 53. This changes the contact point between surfaces 56 and 62 which returns floating carrier 54 to its retracted position of reduced O.D. Sloped surface 58 on the upper end of carrier 54 also acts as a cam to urge carrier 54 radially inward as the tool encounters restrictions in the inner diameter of the wellbore as it is being withdrawn. This may occur particularly at a subsurface safety valve.

Upon recovery of the deburring tool 30 at the surface, shear pin 64 may be replaced and the tool reused for another deburring operation.

Figure 11:
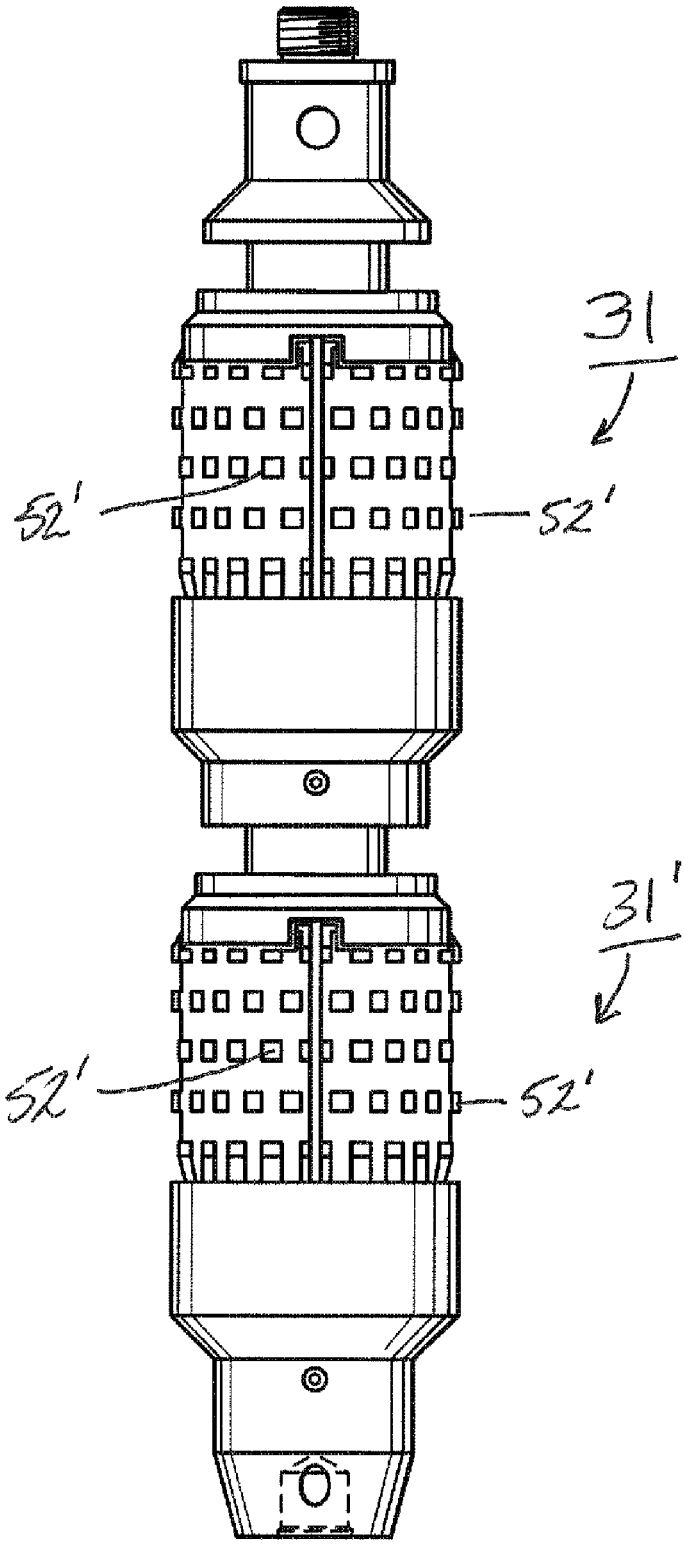
FIG. 11 is an elevation of a pair of deburring tools according to a second embodiment of the invention connected together in-phase (for purposes of illustration).

FIG. 11 illustrates a second embodiment of the invention having an alternative configuration of cutters 52'. FIG. 11 shows deburring tool 31 joined to deburring tool 31'. For purposes of illustration only, the tools are shown aligned in the same direction. When in operating configuration, the two tools 31 and 31' are preferably aligned 90° "out of phase" with each other to achieve substantially 360° coverage of the inner wall—i.e., the retractable cutters of tool 31 are oriented 90° about the central axis relative to the cutters on deburring tool 31'. Other cutter configurations will be readily apparent to those skilled in the art.

Although the invention has been described in detail with reference to certain preferred embodiments, variations and modifications exist within the scope and spirit of the invention as described and defined in the following claims.

What is claimed is:

1. A downhole deburring tool comprising:

a madrel;

a carriage moveable in an axial direction on the mandrel between a first position and a second position;

a retractable cutter carrier having cutters on an outer surface thereof and connected to the carriage which is moveable from a first position wherein the tool has a first, smaller outside diameter to a second position in which the tool has a second, larger outside diameter;

a first cam surface adjacent the cutters on the exterior surface of the carrier configured to urge the retractable carrier towards the first position when the cam surface contacts a section of reduced inside diameter in a wellbore during withdrawal of the tool from a wellbore;

a housing attached to the mandrel and having an outer wall spaced apart from the mandrel which defines an annular space into which at least a portion of the cutter carrier moves when the tool is in the first position; and, a tapered surface on the inner side of the outer wall of the housing which contacts the first cam surface on the exterior surface of the carrier such that axial movement of the carrier changes the point of contact on the tapered surface.

2. A deburring tool as recited in claim 1 wherein changing the point of contact on the tapered surface effects radial movement of the carrier.

3. A deburring tool as recited in claim 1 further comprising resilient elements which bias the carrier in an outward, radial direction.

4. A deburring tool as recited in claim 3 wherein the resilient elements are springs.

5. A deburring tool as recited in claim 4 wherein the springs are coiled springs.

6. A deburring tool as recited in claim 1 further comprising a central axial passageway and a radial passageway in the mandrel which is in fluid communication with the central axial passageway and the external surface of the tool.

7. A downhole deburring tool as recited in claim 1 further comprising a shear pin which restrains the carriage in the first position, the shear pin having a strength selected such that the shear pin will shear when the retractable cutters contact a burr of a certain size on the inner surface of the casing of a cased well when the deburring tool is run into the cased well, said contact creating a force urging the carriage towards the second position.

8. A downhole deburring tool as recited in claim 1 further comprising an opposing second cam surface adjacent the cutters on the exterior surface of the carrier configured to urge the retractable carrier towards the first position when the second cam surface contacts a section of reduced inside diameter in a wellbore during withdrawal of the tool from a wellbore.

* * * * *